US008875482B2

(12) United States Patent
Wassenhoven

(10) Patent No.: US 8,875,482 B2
(45) Date of Patent: Nov. 4, 2014

(54) OPEN-END SPINNING ROTOR

(71) Applicant: Saurer Germany GmbH & Co. KG, Remscheid (DE)

(72) Inventor: Heinz-Georg Wassenhoven, Monchengladbach (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 11 days.

(21) Appl. No.: 13/858,305

(22) Filed: Apr. 8, 2013

(65) Prior Publication Data

US 2013/0283754 A1 Oct. 31, 2013

(30) Foreign Application Priority Data

Apr. 28, 2012 (DE) ..... 10 2012 008 693

(51) Int. Cl.
*D01H 4/10* (2006.01)
*D01H 4/12* (2006.01)

(52) U.S. Cl.
CPC ... *D01H 4/12* (2013.01); *D01H 4/10* (2013.01)
USPC ..... 57/404

(58) Field of Classification Search
USPC ..... 57/404
See application file for complete search history.

(56) References Cited

U.S. PATENT DOCUMENTS 2,750,828 A * 6/1956 Wendling ..... 81/125
4,319,449 A * 3/1982 Hofmann ..... 57/404
4,515,535 A * 5/1985 D'Silva ..... 417/360
4,827,812 A * 5/1989 Markovetz ..... 81/439
5,485,769 A * 1/1996 Olson et al. ..... 81/177.85
5,526,638 A * 6/1996 Bock et al. ..... 57/404
5,555,715 A * 9/1996 Paweletz et al. ..... 57/414
5,634,326 A * 6/1997 Wanger ..... 57/406
5,802,838 A 9/1998 Bock
5,832,711 A * 11/1998 Baumgartner ..... 57/404
5,954,463 A * 9/1999 Jore ..... 408/239 R
6,032,557 A * 3/2000 Anderson ..... 81/451
6,124,658 A 9/2000 Coenen
6,250,185 B1 * 6/2001 Tsung ..... 81/439
6,863,466 B2 * 3/2005 Buhren ..... 403/383
7,225,606 B2 * 6/2007 Hoersch ..... 57/404

(Continued)

FOREIGN PATENT DOCUMENTS

DE 3815182 A1 11/1989
DE 19621190 A1 5/1996

(Continued)

*Primary Examiner* — Shaun R Hurley
(74) *Attorney, Agent, or Firm* — Nelson Mullins Riley & Scarborough LLP

(57) ABSTRACT

An open-end spinning rotor (1), comprising a rotor shaft (4), a rotor cup (2) and a coupling device (3) releasably connecting the rotor shaft (4) and rotor cup (2). The coupling device (3) has locking bodies (6), arranged in a holding element (5) and lock the rotor cup (2) and the rotor shaft (4) in the axial direction under centrifugal force during operation of the open-end spinning rotor (1). A resilient element (7) is associated with the locking bodies (6) and cooperates with the locking bodies (6) such that the locking bodies (6) also lock the rotor cup (2) to the rotor shaft (4) in the axial direction at a standstill. The holding element (5) is configured as a pin which is formed such that it produces a positive shaft-hub connection between the rotor shaft (4) and rotor cup (2) in conjunction with a correspondingly formed hub (8).

11 Claims, 3 Drawing Sheets

(56) References Cited

U.S. PATENT DOCUMENTS

| | | | | |
|---|---|---|---|---|
| 7,594,384 | B2 | 9/2009 | Wassenhoven | |
| 7,605,509 | B2 * | 10/2009 | Buhren | 310/90.5 |
| 8,182,409 | B2 * | 5/2012 | Hoffmann | 494/84 |
| 2002/0006830 | A1 | 1/2002 | Buhren | |
| 2002/0170394 | A1 * | 11/2002 | Tsai | 81/439 |
| 2003/0188609 | A1 * | 10/2003 | Crawley | 81/439 |
| 2006/0130621 | A1 * | 6/2006 | Novak et al. | 81/439 |
| 2008/0190251 | A1 * | 8/2008 | Huang | 81/438 |
| 2010/0062922 | A1 * | 3/2010 | Hoffmann | 494/12 |

FOREIGN PATENT DOCUMENTS

| | | | |
|---|---|---|---|
| DE | 19618027 | A1 | 11/1997 |
| DE | 102005021920 | A1 | 5/2005 |
| DE | 102007007260 | A1 | 8/2008 |
| DE | 102009048295 | A1 | 7/2010 |
| EP | 0972868 | A2 | 1/2000 |
| EP | 1156142 | A1 | 11/2001 |

* cited by examiner

OPEN-END SPINNING ROTOR

BACKGROUND OF THE INVENTION

The present invention relates to an open-end spinning rotor, comprising a rotor shaft, a rotor cup and a coupling device to releasably connect the rotor shaft and rotor cup, the coupling device having locking bodies, which are arranged in a holding element and lock the rotor cup and the rotor shaft in the axial direction as a consequence of the centrifugal force during operation of the open-end spinning rotor, and wherein a resilient element is associated with the locking bodies and the resilient element cooperates with the locking bodies in such a way that the locking bodies also lock the rotor cup to the rotor shaft in the axial direction at a standstill.

In the past, open-end rotor spinning machines used in the textile industry were usually designed in such a way that the spinning rotors were mounted with their rotor shaft in the bearing interstices of a so-called support disc bearing arrangement and were driven, in this case, by means of a tangential belt along the length of the machine.

These spinning rotors, in which the rotor shaft and the rotor cup are virtually non-releasably connected by means of a press fit, may, if necessary, for example in the case of wear or in order to manufacture a different type of yarn on the rotor spinning machine, be installed or disassembled from the front through the opened rotor housing.

Currently, electric motor-driven spinning rotors are increasingly gaining importance. A single motor-driven spinning rotor of this type is, for example, known from European Patent Document EP 0 972 868 A2. The disclosed spinning rotor is supported with its rotor shaft in a magnetic bearing arrangement.

The magnetic bearing arrangement consists here, of a front and a rear bearing point, these bearing points in turn each having axially opposing permanent magnet rings. One of these permanent magnet rings is fixed here, in each case, on the stator, while the other permanent magnetic ring revolves with the rotor shaft.

As the installation and disassembly of spinning rotors mounted in this manner requires a not inconsiderable assembly outlay, the rotor cup is in each case releasably connected to the rotor shaft in these spinning rotors. A possibility for a releasable connection of this type is described in European Patent Document EP 1 156 142 B1. This is realised by means of a coupling device, which consists of a magnetic bearing arrangement for the axial locking of the rotor shaft and rotor cup and a mechanical anti-rotation device, which prevents any relative rotational movement between the rotor shaft and rotor cup by means of positive engagement. A receiving sleeve is let into the rotor shaft by means of a press fit. A permanent magnet and an internal polygon are let in the receiving sleeve in the axial direction one behind the other. The rotor cup has a stub shaft with an external polygon, which corresponds with the internal polygon.

Types of connection, which transmit torques and powers from a rotating shaft or a rotating pin to a hub or vice versa from a rotating hub to a shaft or a pin, are called shaft-hub connections in mechanical engineering. The internal polygon, in conjunction with the external polygon, forms a positive shaft-hub connection. However, even before the establishing of single motor drives, there were attempts to form the connection of the rotor cup and rotor shaft releasably. Examples are found in German Patent Documents DE 38 15 182 A1 and in DE 196 18 027 A1.

German Patent Document DE 38 15 182 A1 discloses various examples, in which the coupling in the axial direction and the torque transmission from the rotor shaft to the rotor cup is realised either by a non-positive or a positive connection. To transmit the torque, in one embodiment, the rotor cup is provided on the external region of its base with connecting pins, which are introduced into two axially parallel bores of a coupling disc fastened to the rotor shaft. For axial fixing, inter alia, a spring steel strip bent in an undulating manner or an S-shaped resilient locking element are proposed. Both parts deform under the influence of centrifugal forces and then engage in indentations at the end of the connecting pins. In the rest state, the rotor cup and rotor shaft are not axially locked. Presumably for this reason, the connecting pins are relatively long to prevent the rotor cup from falling out in the rest state under the influence of gravitational force. The long connecting pins are rather unfavourable for handling.

The generic German Patent Document DE 196 18 027 A1 discloses a coupling mechanism between the rotor cup and rotor shaft, which produces an exclusively non-positive connection both in the axial direction and also for torque transmission. This is a centrifugal force coupling with spherical locking bodies. When the spinning rotor is made to rotate, the centrifugal forces, because of the construction of the coupling, ensure a locking in the axial direction and in the rotational direction. In addition, the coupling has a resilient element, which, for example, can be configured as a rubber block or as a spring element. The resilient element is arranged in such a way that the locking bodies can even be pressed outwardly without a rotational movement in relation to the rotational axis of the spinning rotor. A locking is thus also present when the spinning rotor is at a standstill. To connect the spinning cup and rotor shaft, the locking bodies can be easily pressed together. The disadvantage in this arrangement is that with an increasing rotational speed of the spinning rotor, the purely non-positive transmission of the torque no longer works reliably.

According to German Patent Document DE 196 18 027 A1, the coupling with the locking bodies is to be configured as a separate component. The manufacturing tolerances add up in accordance with the number of components, so that more components lead to greater imprecisions and therefore to a greater imbalance. At the high rotational speeds at which spinning rotors are operated, this imbalance can lead to problems, through to damage to the spinning unit.

SUMMARY OF THE INVENTION

The object of the present invention is to provide, proceeding from German Patent Document DE 196 18 027 A1, a spinning rotor with a compact and reliable coupling device.

The invention is embodied in an open-end spinning rotor basically comprising a rotor shaft, a rotor cup and a coupling device for releasably connecting the rotor shaft and rotor cup. The coupling device has locking bodies, which are arranged in a holding element and lock the rotor cup and the rotor shaft in the axial direction as a consequence of the centrifugal force during operation of the open-end spinning rotor. A resilient element is associated with the locking bodies and the resilient element cooperates with the locking bodies in such a way that the locking bodies also lock the rotor cup to the rotor shaft in the axial direction at a standstill. To achieve the object according to the present invention, the holding element is configured as a pin and the pin is formed in such a way that it produces a positive shaft-hub connection between the rotor shaft and rotor cup in conjunction with a correspondingly formed hub. Advantageous further developments of the invention are described hereinafter.

The invention easily realises a positive connection to transmit a torque from the rotor shaft to the rotor cup. Consequently, the torque can also be reliably transmitted at relatively high rotational speeds. Owing to the shape according to the invention of the holding element for the locking bodies, a compact and space-saving arrangement is provided. A separate axle element for the positive connection is not required. The arrangement according to the invention has few individual parts. As a result, an adding up of manufacturing tolerances can be reduced, so the spinning rotor has a small imbalance.

Shapes, known per se, for shaft-hub connections can be used for the shape of the holding element configured as a pin. The positive connection may, for example, be achieved by a spline shaft profile, a polygonal profile or a serration.

A simple but effective shape for the positive connection is a circular cylindrical shape with at least one level face on the periphery.

The hub preferably has receivers, which at least partly receive the locking bodies in the assembled state. The centrifugal force acting in the radial direction firstly brings about a non-positive locking in the axial direction. The receiver means that a positive engagement is additionally achieved, which improves the locking in the axial direction. The receiver may, for example, be configured as a V-shaped groove. For functioning, it is sufficient if the groove is present in the region of the locking bodies. For manufacturing reasons, the groove is, however, advantageously configured running along the periphery of the hub.

The receivers advantageously in each case have a face, against which the locking bodies press, and the rotor shaft and the rotor cup in each case have a stop for limiting an axial movement, the receivers and the face being configured in such a way that the force acting in the radial direction on the locking bodies is converted into a force in the axial direction of the open-end spinning rotor and the stops of the rotor shaft and rotor cup are thereby pressed against one another.

If the receivers are configured as a V-shaped groove, this mode of action can be achieved by an asymmetrical structure of the groove. The groove is designed in such a way that the locking bodies only press against one of the oblique faces and the radial force is thus converted into an axial force. If stops of the rotor cup and rotor shaft are pressed against one another by the axial force, an optimal locking is achieved in the axial direction.

The stops have stop faces. The stop faces are preferably arranged perpendicular to the axis of the open-end spinning rotor and their geometric focal point is located on the axis of the open-end spinning rotor. In this configuration of the stops, a centring of the rotor cup is additionally achieved by the axial force against the stops. In other words, an angular offset between the axis of the rotor shaft and the axis of the rotor cup is avoided.

Spherical locking bodies are particularly advantageous for centrifugal force couplings of the claimed type. A spherical locking body works particularly effectively in conjunction with a V-shaped groove on the hub. The spherical locking body rests on an oblique face of the groove, so that the centrifugal force is converted into an axial force.

The holding element with the locking bodies is preferably rigidly connected to the rotor shaft and the hub is configured as part of the rotor cup. Owing to the arrangement of the holding element on the rotor shaft, the rotor cup, which is exchanged when necessary, can be designed particularly simply.

The invention also relates to a rotor cup for an open-end spinning rotor with a hub, the hub being formed in such a way that, in conjunction with a correspondingly formed pin of a rotor shaft, it produces a positive shaft-hub connection, the hub, on its internal periphery, having receivers, which are configured to at least partly receive locking bodies connected to a rotor shaft, the receivers having a face, which is configured in such a way that a force, which a locking body exerts on the face in the radial direction, is converted into a force in the axial direction of the rotor cup.

The rotor cup preferably has stops with stop faces, which are arranged perpendicular to the axis of the rotor cup and the geometric focal point of which is located on the axis of the rotor cup.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
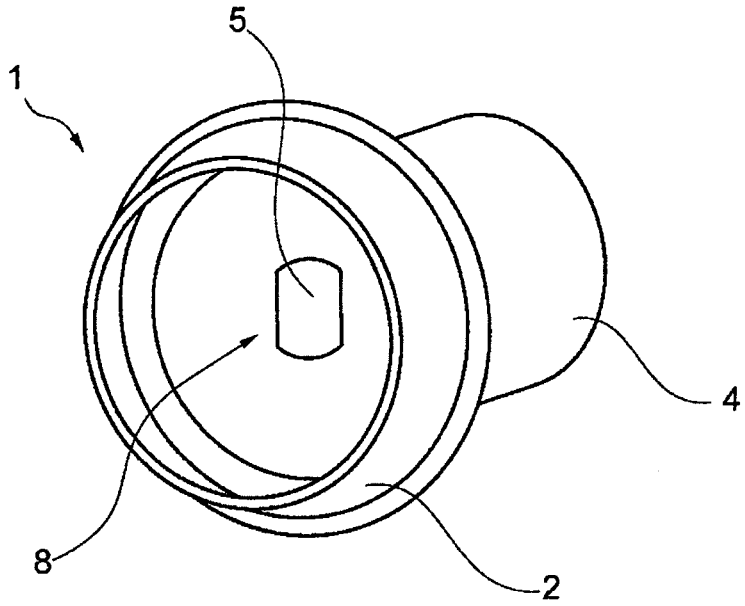
FIG. 1 shows a spinning rotor according to the invention.
Figure 2:
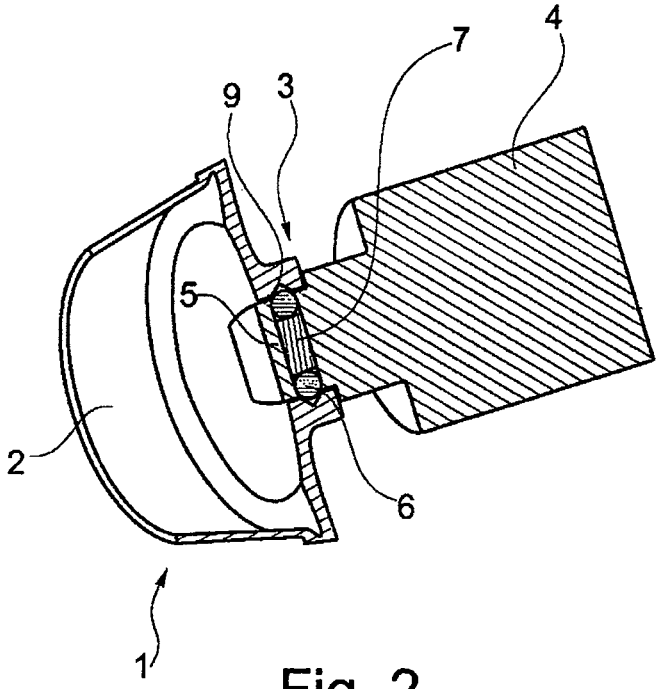
FIG. 2 shows the spinning rotor from FIG. 1 in a sectional view.

FIGS. 1 and 2 show a spinning rotor 1 according to the invention. The spinning rotor 1 comprises a rotor shaft 4 and a rotor cup 2. The rotor shaft 4 and the rotor cup 2 are releaseably connected to one another, so the rotor cup 2 can be exchanged when necessary. The rotor shaft 4 is connected to a drive, not shown. As the rotor cup 2 is exchangeable, the rotor shaft 4 can be rigidly integrated in the drive, preferably a single drive.

Figure 3:
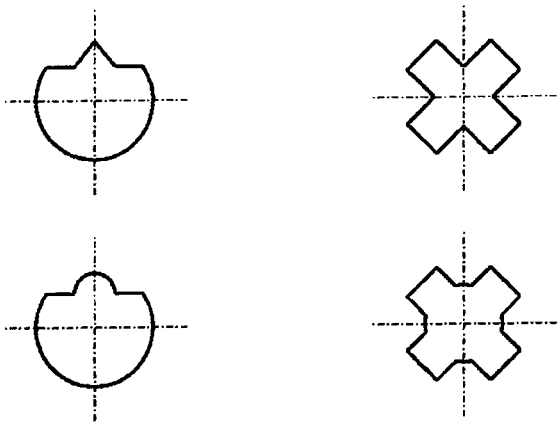
FIG. 3 shows possible shapes for a positive shaft-hub connection by spline shaft profiles.
Figure 4:
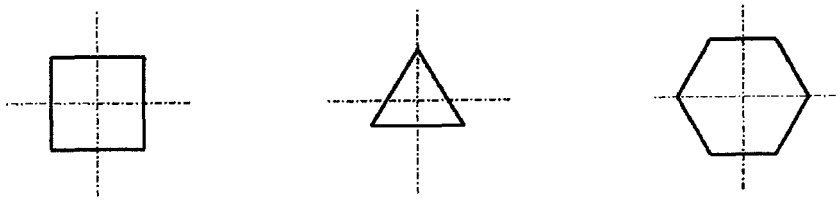
FIG. 4 shows possible shapes for a positive shaft-hub connection by polygonal profiles.
Figure 5:
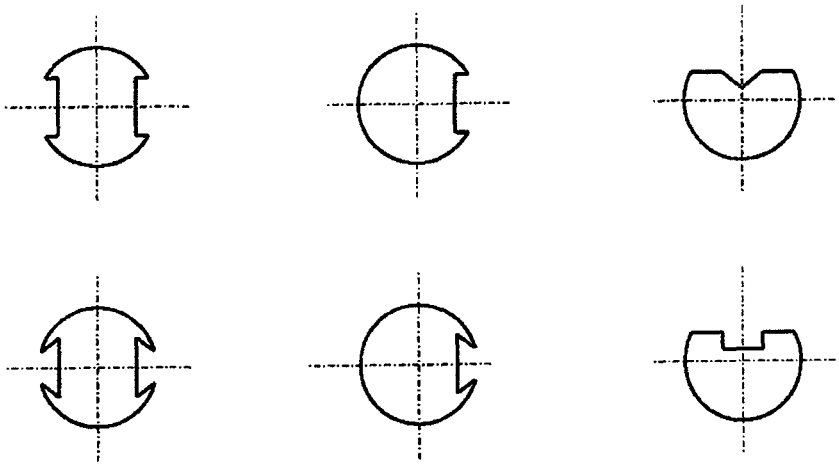
FIG. 5 shows possible shapes of a positive shaft-hub connection by serration.

In order to realise a releasable connection, the spinning rotor 1 has a coupling device 3. In the embodiment shown, the rotor shaft 4 comprises a pin 5 and the rotor cup 2 a hub 8. The external shape of the pin 5 and the internal shape of the hub 8 correspond to one another, so when placing the rotor cup 2 on the pin 5 of the rotor shaft 4, a positive shaft-hub connection is produced and therefore a torque can be transmitted. The embodiment shown in FIGS. 1 and 2 has a pin 5 with a circular cylindrical external shape. In order to achieve a positive connection, the circular cylinder has two level faces on its periphery. FIGS. 3 to 5 show, by way of example, alternative shapes for a positive anti-rotation device between the pin 5 and hub 8. FIG. 3 shows spline shaft profiles. FIG. 4 shows polygonal profiles. FIG. 5 shows shapes with a serration.

The pin 5 is simultaneously configured as a holding element for the locking bodies 6. Two balls are present as locking bodies 6 in the embodiment shown. Arranged between the balls 6 is a resilient element 7, which also presses the balls outwardly in the rest state of the spinning rotor. The resilient element 7 may, for example, be configured as a rubber block or as a spring. When using two locking bodies, in the present embodiment two balls 6, a simple structure is produced. The two balls 6 can be introduced by the resilient element into a transverse bore of the pin 5. By means of a so-called embossing, a small bead is produced at the ends of the transverse bore. The balls 6 are held by the resilient element 7 in the transverse bore by this embossing. In the installed state, the balls 6 are pressed into the receivers 9 of the hub 8 of the rotor cup 2. The receivers 9 are configured as a V-shaped peripheral groove in the hub. The forces of the resilient element 7 can be easily overcome during the pulling off and placing on of the rotor cup 2. When the spinning rotor 1 is made to rotate, centrifugal forces act on the balls 6 so that the balls are pressed into the groove 9 with a greater force.

Figure 6:
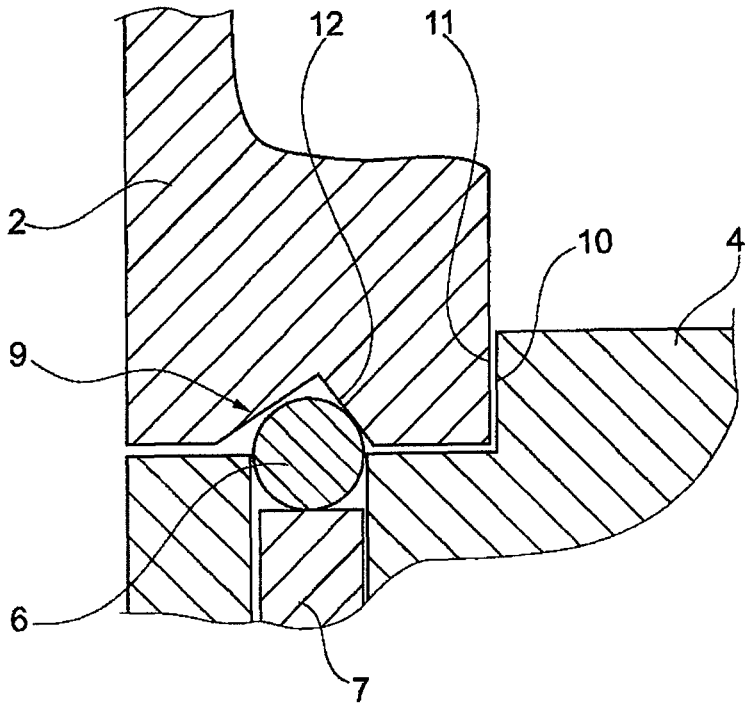
FIG. 6 shows a detail of the view of FIG. 2.

FIG. 6 shows a detail from FIG. 2 and makes the mode of action of a possible axial lock clear. In the enlarged view, the non-symmetrical structure of the groove 9 can be seen. The arrangement is such that the ball 6 only presses against the face 12 facing the rotor shaft 4. As a result, the centrifugal force or the force of the resilient element 7 is converted into an axial force. The axial force is directed in such a way that the stop 11 of the rotor cup 2 is pressed against the stop 10 of the rotor shaft 4. The stops 10 and 11 are arranged rotationally symmetrically. The geometric focal point of the stop faces is therefore on the rotational axis of the open-end spinning rotor 1. As the stops 10, 11 are pressed against one another, not only does an axial locking thus take place, but also a centring of the rotor cup.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Open-end spinning rotor (1), comprising a rotor shaft (4), a rotor cup (2) and a coupling device (3) for releaseably connecting the rotor shaft (4) and rotor cup (2), wherein the coupling device (3) has locking bodies (6), which are arranged in a holding element (5) and lock the rotor cup (2) and the rotor shaft (4) in the axial direction as a consequence of the centrifugal force during operation of the open-end spinning rotor (1), and wherein a resilient element (7) is associated with the locking bodies (6) and the resilient element (7) cooperates with the locking bodies (6) in such a way that the locking bodies (6) also lock the rotor cup (2) to the rotor shaft (4) in the axial direction at a standstill, characterized in that the holding element (5) is configured as a pin and the pin is formed in such a way that it produces a positive shaft-hub connection between the rotor shaft (4) and rotor cup (2) in conjunction with a correspondingly formed hub (8), wherein the hub (8) has receivers (9), which at least partly receive the locking bodies (6) in the assembled state, the receivers (9) in each case have a face (12), against which the locking bodies (6) press, and the rotor shaft (4) and the rotor cup (2) in each case have a stop 11) to limit an axial movement, the receivers (9) and the face (12) being configured in such a way that the force acting in the radial direction on the locking bodies (6) is converted into a force in the axial direction of the open-end spinning rotor (1) and the stops (10, 11) of the rotor shaft (4) and rotor cup (2) are thereby pressed against one another.

2. Open-end spinning rotor (1) according to claim 1, characterized in that the positive connection is achieved by a spline shaft profile.

3. Open-end spinning rotor (1) according to claim 1, characterized in that the positive connection is achieved by a polygonal profile.

4. Open-end spinning rotor (1) according to claim 1, characterized in that the positive connection is achieved by a serration.

5. Open-end spinning rotor (1) according to claim 1, characterized in that the positive connection is achieved by a circular cylindrical shape with at least one level face on the periphery.

6. Open-end spinning rotor (1) according to claim 1, characterized in that the stops (10, 11) have stop faces, which are arranged perpendicular to the axis of the open-end spinning rotor (1) and the geometric focal point of which is located on the axis of the open-end spinning rotor (1).

7. Open-end spinning rotor (1) according to claim 1, characterized in that the locking bodies (6) are spherical.

8. Open-end spinning rotor (1) according to claim 1, characterized in that the holding element (5) with the locking bodies (6) is rigidly connected to the rotor shaft (4).

9. Open-end spinning rotor (1) according to claim 8, characterized in that the hub (8) is configured as part of the rotor cup (2).

10. Rotor cup (2) for an open-end spinning rotor (1) with a hub (8), the hub (8) being formed in such a way that, in conjunction with a correspondingly formed pin (5) of a rotor shaft (4), it produces a positive shaft-hub connection, the hub (8), on its inner periphery, having receivers (9), which are configured to at least partly receive locking bodies (6) connected to a rotor shaft, the receivers (9) having a face, which is configured in such a way that a force, which a locking body (9) exerts on the face in the radial direction, is converted into a force in the axial direction of the rotor cup (2).

11. Rotor cup according to claim 10, characterized in that the rotor cup (2) has stops (11) with stop faces, which are arranged perpendicular to the axis of the rotor cup and the geometric focal point of which is located on the axis of the rotor cup.

* * * * *